United States Patent [19]

Mertz

[11] Patent Number: 4,461,331

[45] Date of Patent: Jul. 24, 1984

[54] APPARATUS FOR SPLITTING LOGS

[75] Inventor: Forrest H. Mertz, Ponca City, Okla.

[73] Assignee: Mertz, Inc., Ponca City, Okla.

[21] Appl. No.: 417,145

[22] Filed: Sep. 13, 1982

[51] Int. Cl.[3] ..... B27I 7/00

[52] U.S. Cl. ..... 144/193 A; 144/193 E

[58] Field of Search ..... 144/193 R, 193 A, 193 B, 144/193 C, 193 D, 193 E, 193 F, 193 G, 193 H, 193 J, 193 K

[56] References Cited

U.S. PATENT DOCUMENTS

| | | | |
|---|---|---|---|
| 508,221 | 11/1893 | Hill | 144/193 A |
| 881,538 | 3/1908 | Bienk | 144/193 H |
| 4,240,476 | 12/1980 | Rattray | 144/193 R |
| 4,286,638 | 9/1981 | Connolly et al. | 144/193 A |
| 4,351,377 | 9/1982 | Hamel | 144/193 A |
| 4,371,020 | 2/1983 | Barnes et al. | 144/366 |

FOREIGN PATENT DOCUMENTS

| | | | |
|---|---|---|---|
| 2902783 | 8/1979 | Fed. Rep. of Germany | 144/193 R |

*Primary Examiner*—W. D. Bray
*Assistant Examiner*—Jorji M. Griffin
*Attorney, Agent, or Firm*—Dunlap & Codding

[57] ABSTRACT

An apparatus for splitting logs into billets and having a pivoting splitter head mounted at one end of an elongated log support upon which logs are placed for splitting. The splitter head is supported by a pin extending from a splitter head mount attached to the log support toward a pusher that forces the log into the splitter head. Platforms are attached to the pusher and extend therefrom along the sides of the log support to receive the billets into which a log is split, the attachment of the platforms to the pusher maintaining the platforms in lateral alignment with the log as the log is split. The apparatus is mounted on a wheeled chassis having a trailer tongue at one thereof for towing the apparatus to a work site.

7 Claims, 8 Drawing Figures

APPARATUS FOR SPLITTING LOGS

BACKGROUND OF THE INVENTION

1. Field of the Invention

The present invention relates generally to improvements in log splitting machines and, more particularly, but not by way of limitation, to machines in which a log is forced along a path to be intercepted by a splitting device at one end of the path.

2. Brief Discussion of the Prior Art

With the recent increased demand for firewood, machines have been developed to rapidly split logs into billets while eliminating the labor that has been associated with such work in the past. These machines generally comprise an elongated support upon which a log is placed for splitting, a hydraulically driven pusher that forces the log endwise along the support, and a blade at one end of the support to intercept the moving log and split it into two billets as the log moves past the blade.

While these machines have generally been successful in accomplishing their basic purpose of reducing the time and labor required to convert logs into billets of a size suitable for use as firewood in fireplaces, barbecue pits and the like, their labor saving potential has not been fully realized and, in addition, presently available machines are generally wasteful of fuel in their operation. In part, these problems are related to the nature of the job that the machines accomplish; that is, the division of a piece of wood into two parts.

Wood has a grain and, because of the grain, the resistance of a log to passage of the blade will vary with the path the blade takes through the log. In particular, a straight line path through the log defined by a fixed blade will usually not be the path of least resistance of the blade through the log. This path dependence of the resistance of the log to splitting can have a strong effect on fuel consumption; that is, the greater the resistance to splitting that the log exhibits, the more work the machine must do and the more fuel it must consume to do this work. Moreover, the path dependence of the resistance of the log to splitting unduly limits the size of logs that a machine of this type can handle. The power source for the machine, usually a small internal combustion engine, has a limited power capability so that any factor, other than size, that has the effect of increasing the resistance of a log to splitting must be offset by a corresponding reduction in the maximum size of the logs that can be split by the machine. Since logs that cannot be split by the machine must often be split manually, the dependence of the resistance of the log to splitting upon the path of the blade through the log can partially defeat the labor saving benefit the machine is designed to afford the user. This is particularly true where the operator of the machine misjudges a log with the result that the machine jams during use. In this case, manual labor must also be expended to free the log from the blade in order that manual splitting can be carried out.

The saving of labor by the use of these machines is also incomplete in a particular respect. Following the splitting operation, the billets must be picked up for transport to a rick or, in some cases, to return the billets to the machine for splitting into smaller size billets. Where a large quantity of firewood is to be cut into billets; for example, where the machine is used by a commercial supplier of firewood, this stoop labor is by no means inconsequential. Moreover, the need for engaging in this labor tends to slow the production rate of appropriately sized billets to reduce the income that a seller of firewood can realize from his investment in the machine.

SUMMARY OF THE INVENTION

The present invention solves these problems by providing a log splitting apparatus in which the log is driven into a splitter head which automatically selects a path of least resistance through the log. To this end, the splitter head, upon which an edge is formed to meet the oncoming log, is mounted on a fixed splitter head mount to pivot about an axis that extends along the path of travel of the log. The splitter head can thus rotate as it passes through the log to follow the natural grain of the wood with result that the work that must be done to force the log past the splitter head is minimized for a considerable saving in fuel consumption by the machine. Moreover, by so reducing the resistance to splitting encountered by the machine, the present invention provides an additional benefit in the form of the labor that the machine operator can save by using the machine, rather than hand tools, to cut larger logs that would jam prior art machines having a power source comparable to that used in the present invention.

The labor saving aspect of the present invention is carried further by the provision of a novel billet catcher that avoids the need for stooping to retrieve billets from the ground for transport to a rick or for a second pass through the machine. In particular, the billet catcher of the present invention is comprised of two platforms that are mounted on the sides of the machine to catch the billets as they are formed and maintain them at the height of the elongated log support for ease of subsequent handling. A novel aspect of the billet catcher is that the platforms move with the log pusher and, accordingly, with the log so that no tendency will exist for the billets to skitter across the platforms as they move from the elongated support along which they are forced. Rather, because the platforms are moving with the log, the billets are laid on the platforms as the log breaks into two pieces. Thus, the platforms can be made relatively small so that they will not interfere with the placement of logs on the machine and, in addition, they facilitate the placement of large billets on the log travel path for successive splitting operations into which billets formed by splitting a log are themselves split. To effectuate the movement of the platforms with the log, the platforms are connected to the log pusher to lie alongside the position on the log travel path that a log occupies as the operation commences. Accordingly, when the log pusher is drawn away from the splitter head, following an operation of the machine, to prepare for a succeeding operation of the machine, each billet is drawn back to a position alongside that initially occupied by the log. Accordingly, a large billet is easily transferred back to the log travel path on the machine by merely moving it laterally from the platform upon which it rests to the elongated support that defines the log travel path.

An object of the present invention is to increase the economy of operation of log splitting machines.

Another object of the present invention is to minimize fuel consumption in the operation of such machines.

A further object of the present invention is to provide an apparatus for splitting logs that is capable of splitting large diameter logs.

Still another object of the invention is to limit the manual labor that must be done in log splitting operations.

Another object of the invention is to provide an apparatus for splitting logs that combines low fuel consumption with maximum log size capability.

Yet a further object of the invention is to provide a log splitting apparatus that combines a minimization of the expenditure of manual labor with fuel efficiency and log splitting capability.

Other objects, advantages and features of the present invention will become clear from the following detailed description of the preferred embodiment of the invention when read in conjunction with the drawings and appended claims.

BRIEF DESCRIPTION OF THE DRAWINGS

FIG. 8 is a cross-section of the catcher assembly of the log splitting apparatus taken along line 8—8 of FIG. 2.

DESCRIPTION OF THE PREFERRED EMBODIMENT

Figure 1:
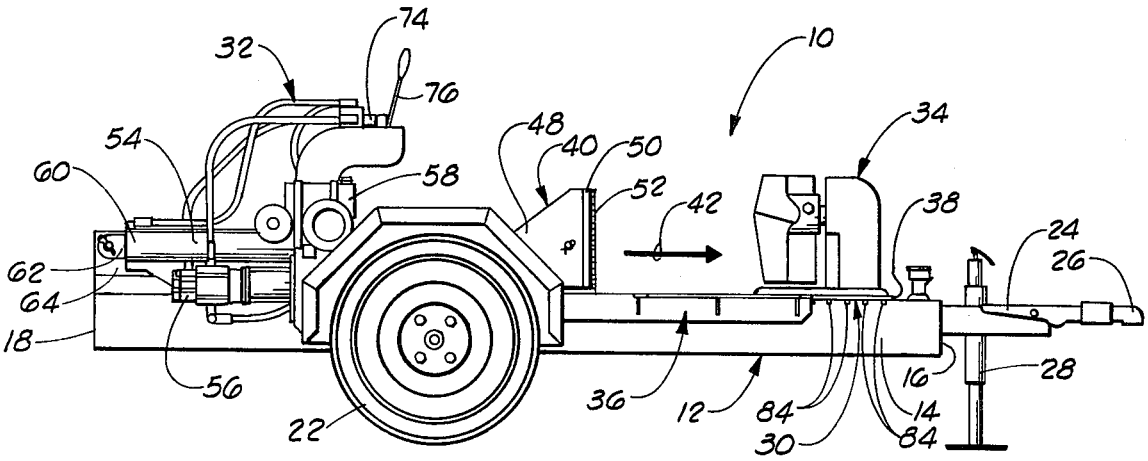
FIG. 1 is a side elevational view of a log splitting apparatus constructed in accordance with the present invention.
Figure 2:
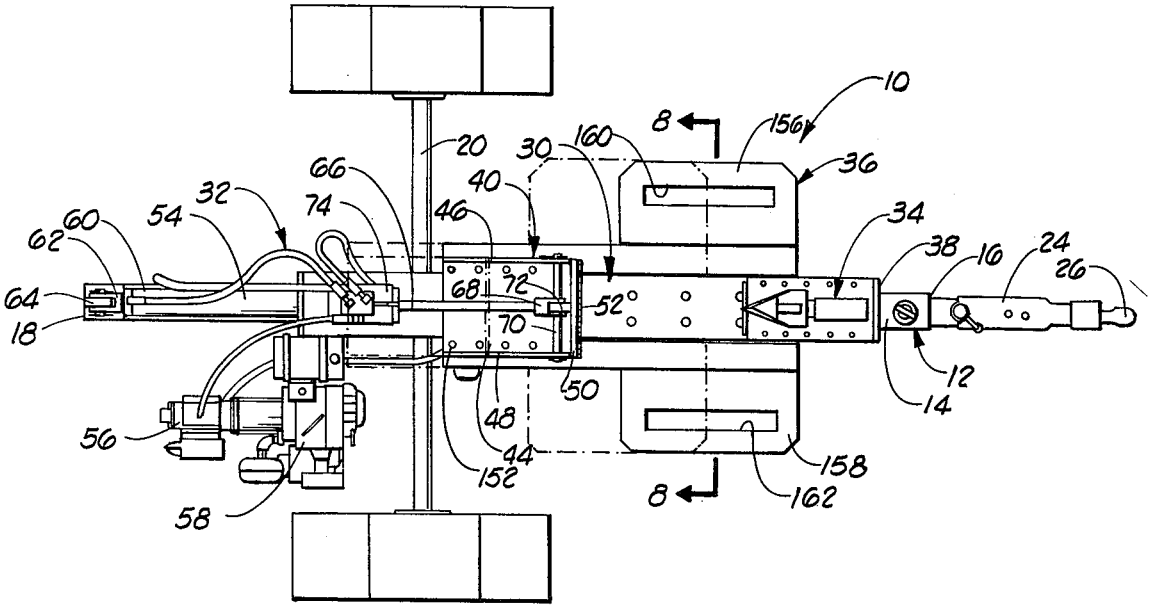
FIG. 2 is a plan view of the log splitting apparatus.

Referring now to the drawings in general and to FIGS. 1 and 2 in particular, shown therein and designated by the general reference numeral 10 is a log splitting apparatus constructed in accordance with the present invention. It is contemplated that the working parts of the apparatus 10 will be assembled into a mobile, self-contained unit for use at various work sites and, for this purpose, the apparatus 10 is preferably mounted on a trailer 12 as has been shown in FIGS. 1 and 2. In order to provide a complete description of the construction of the apparatus 10, it will, accordingly, be useful to first briefly describe the trailer 12 upon which the apparatus 10 is assembled.

The chassis 14 of the trailer 12 is formed from a length of rectangular tubing, one end 16 of the tubing forming a forward end of the chassis 14 and the other end 18 of the tubing forming a rear end of the chassis 14. An axle 20 is attached to the underside of the chassis 14 by conventional means to extend laterally of central portions of the chassis 14 and wheels, one of which is shown in FIG. 1 and designated by the numeral 22 therein, are conventionally mounted on the ends of the axle 20 to support central and rear portions of the chassis 14. A trailer tongue 24 is connected to the chassis 14 to extend from the forward end 16 thereof and the trailer tongue 24 carries a conventional trailer hitch 26 at its distal end for towing and further carries an extensible leg 28 that may be lowered to support portions of the chassis 14 near the forward end 16 thereof when the log splitting apparatus 10 is in use.

Turning now to the log splitting apparatus 10 proper, the apparatus 10 generally comprises a log support 30; a log drive assembly 32; a splitter assembly 34; and a catcher assembly 36. In the preferred embodiment, the log support 30 is an elongated plate which is welded to the upper side of the chassis 14 and extends therealong from a forward end 38 of the log support 30, positioned near the forward end 16 of the chassis 14, to a rear end (not shown) of the log support 30 that is disposed above medial portions of the chassis 14. During log splitting operations, logs are placed on the log support 30 and driven therealong into the splitter assembly 34 by means of the log drive assembly 32.

The log drive assembly 32 comprises a pusher 40 which is mounted atop the log support 30, in a manner to be described below, to engage one end of a log placed on the log support 30 and force the log along a drive path 42 directed toward the forward end of the log support 30. In the preferred construction of the pusher 40, the pusher comprises a base plate 44 which slides along the log support 30, spaced side plates 46 and 48 which are welded to the base plate 44 and extend normally to the base plate 44 away from the log support 30, and a pusher plate 50 that is welded to the base plate 44 and to the side plates 46, 48 to face toward the forward end 38 of the log support 30. Such construction of the pusher 40 provides the pusher 40 with a rigidity and strength sufficient to enable the pusher 40 to withstand the forces exerted thereon as the pusher 40 forces logs into the splitter assembly 34. The pusher plate 50 is faced with a sheet 52 of expanded metal to grip the end of a log being split during operation of the apparatus 10 and prevent the log from becoming misaligned with the drive path 42.

The motive force for the pusher 40 is provided by a hydraulic actuating cylinder 54, a hydraulic pump 56 and an internal combustion engine 58. The pump 56 is mounted directly on the engine 58 and the engine 58 is mounted on the chassis 14 via a laterally extending arm (not shown) that is welded to the chassis 14 rearwardly of the axle 20, between the chassis 14 and the wheel 22, so that the engine 58 and pump 56 are positioned so as not to interfere with the operation of the apparatus 10. The mounting of the engine 58 and the pump 56 on the chassis 14 assembles the apparatus 10 into a self-contained unit which can be taken to various work sites for log splitting operations.

The hydraulic actuating cylinder 54 comprises a cylinder body 60 which has one end fixed to the chassis 14, adjacent the rear end 18 of the chassis 14, via a clevis 62 on such end of the cylinder body 60 and a support 64 that is welded atop the chassis 14. The support 64 is aligned with the chassis 14 such that the hydraulic actuating cylinder 54 extends above, and parallel to, the chassis 14 toward the pusher 40 and the hydraulic actuating cylinder 54 further comprises a piston rod 66 that extends from the unattached end of the cylinder body 60 to the pusher 40. The piston rod 66 is connected to the pusher 40 via a clevis 68, on the distal end of the piston rod 66, and a pin 70 that extends through the clevis 68, through apertures (not shown) formed in the side plates 46, 48 of the pusher 40, and through an aperture formed through a lug 72 welded to the rear side of the pusher plate 50 and to the base plate 44. Hydraulic conduits (not numerically designated in the drawings), connect the hydraulic actuating cylinder 54 to the pump 56 via a manually operated 4-way valve 74 so that the operator of the apparatus 10 can cause the pusher 40 to move toward, or away from, the forward end 30 of the log support 30 by moving an operating handle 76 attached to the valve 74 toward, or away from, the forward end 30 of the log support 30.

Figure 3:
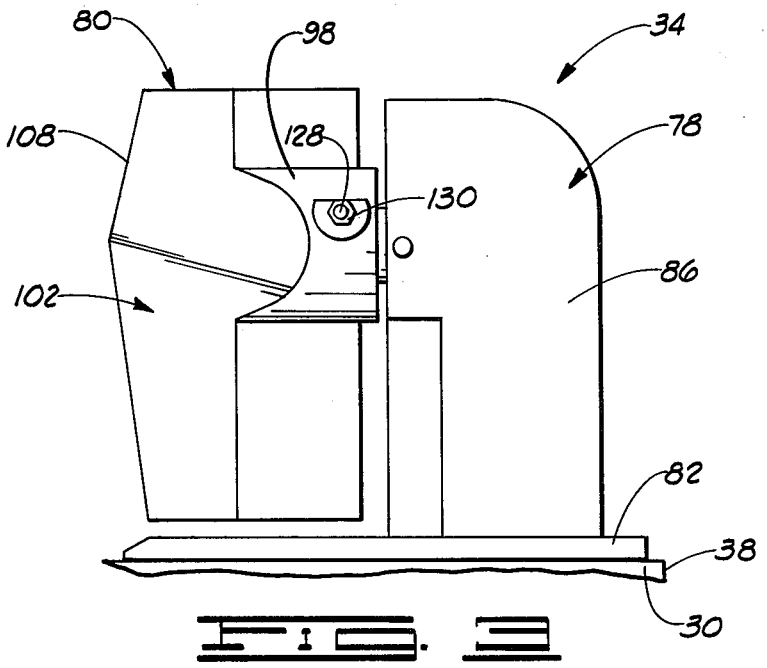
FIG. 3 is a side elevational view of the splitter head assembly of the log splitting apparatus.
Figure 4:
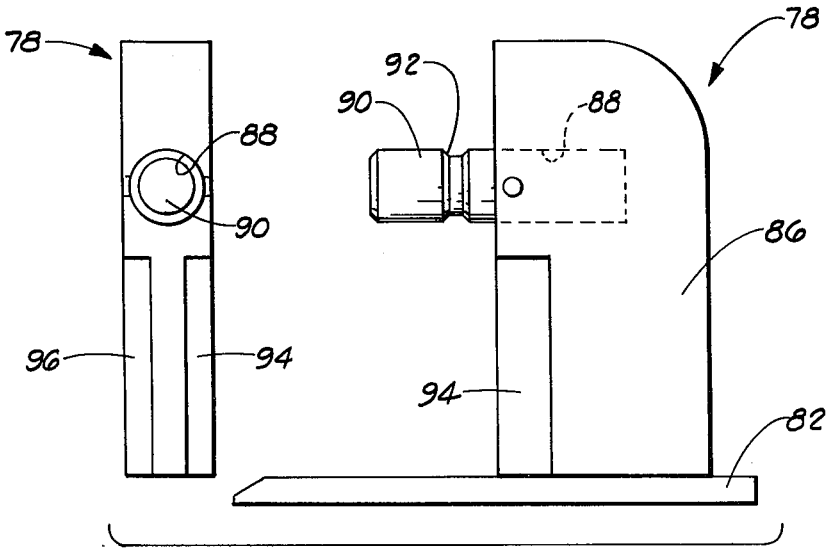
FIG. 4 is a composite view of the splitter head mount showing the splitter head mount in front and side elevation.

The splitter assembly 34 comprises a splitter head mount 78, which is more particularly shown in FIGS. 3 and 4, and a splitter head 80 which is more particularly shown in FIGS. 3 and 5 through 7. Referring first to FIGS. 3 and 4, the splitter head mount 78 comprises a base plate 82 that is mounted on the log support 30 adjacent the forward end 38 of the log support 30. (The mounting of the base plate 82 on the log support 30 is conveniently accomplished via aligned holes, not shown, formed through the log support 30 and the base plate 82 to receive bolts, shown in FIG. 1 and designated by the numeral 84 therein, that extend through the holes in the log support 30 and screw into the holes in the base plate 82, the holes in the base plate 82 being threaded for this purpose.) Welded to the splitter head mount base plate 82 to extend normally to the log support 30, the splitter head mount 78 comprises a pin support member 86 that is constructed of heavy gauge sheet steel and that has a cylindrical socket 88 formed in one side thereof. In the assembled log splitting apparatus 10, the base plate 82 is bolted to the log support 30 such that the socket 88 faces the pusher 40 and is axially aligned with the drive path 42. The socket 88 receives a portion of a splitter head mounting pin 90 so that remaining portions of the pin 90 protrude from the socket 88 in axial alignment with the drive path 42 for mounting the splitter head 80 on the splitter head mount 78. The portion of the splitter head mounting pin 90 disposed in the socket 88 is shaped to mate with the socket 88 and can be conveniently secured therein by plug welding the pin 90 to the pin support member 86 via holes formed in the sides of the member 86 to intersect the socket 88. Exteriorly of the pin support member 86, the splitter head mounting pin 90 is provided with a circumferentially extending groove 92 to secure the splitter head 80 thereon as will be discussed below. Portions of the pin support member 86 adjacent the base plate 82 of the splitter head mount 78 are provided with chamfers 94 and 96 that intersect the side of the pin support member 86 that faces the pusher 40 and extend to laterally disposed sides of the pin support member 86 to eliminate sharp corners on the pin support member 86 that might be engaged by ends of billets moving past the pin support member 86.

Figure 5:
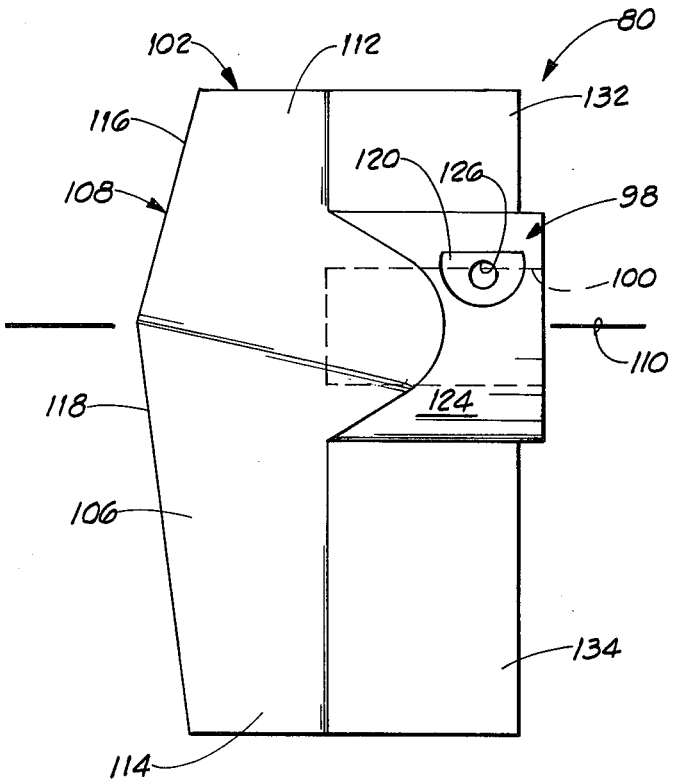
FIG. 5 is a side elevational view of the splitter head of the log splitting apparatus.
Figure 6:
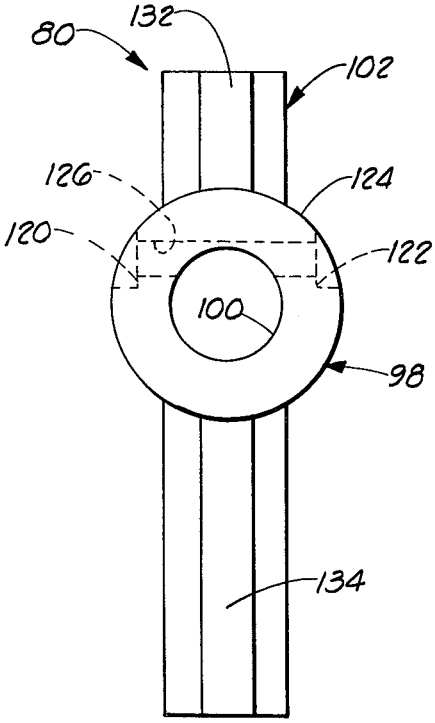
FIG. 6 is a rear elevational view of the splitter head.
Figure 7:
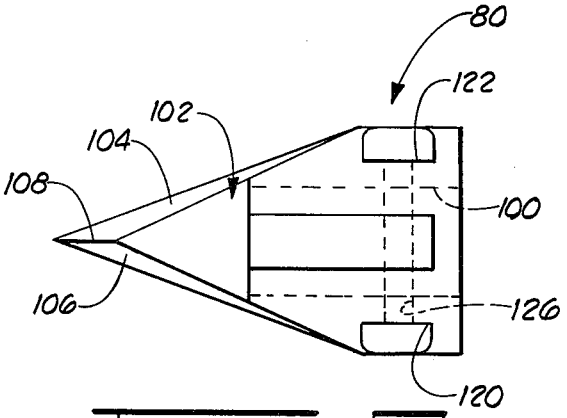
FIG. 7 is a plan view of the splitter head.
Figure 5:
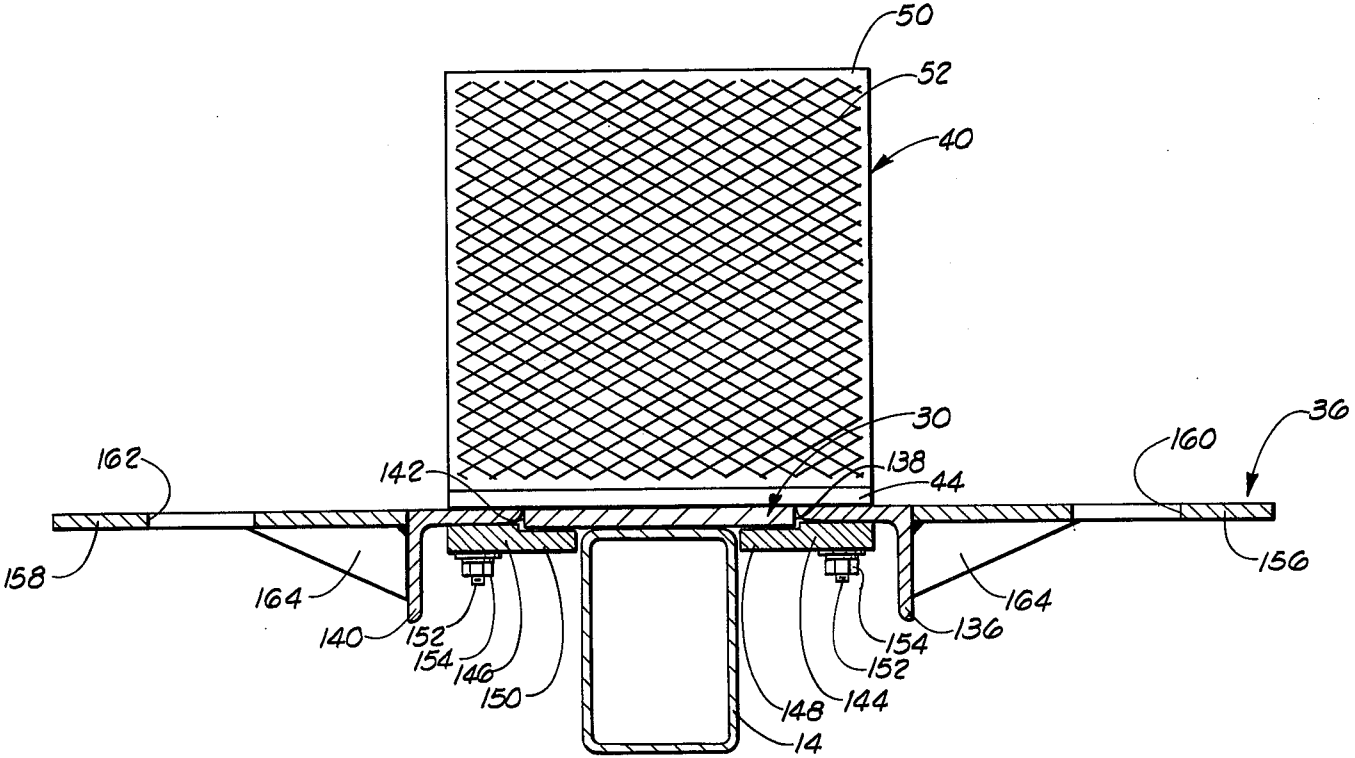

With continuing reference to FIG. 3 and with reference to FIGS. 5 through 7, the splitter head 80 comprises a generally cylindrical body portion 98, having a socket 100 formed in one end thereof to extend axially into the body portion 98 and a cross bar portion 102 that is formed unitarily with the body portion 98 to extend across the opposite end of the body portion 98 and close the interior end of the socket 100. Lateral sides 104, 106 of the cross bar portion 102 are angled to intersect and form a splitter edge 108 on the side of the cross bar portion 102 opposite the side thereof that engages the body portion 98. The angular disposition of the sides 104, 106 of the cross bar portion 102 is continued into the body portion 98 so that the splitter head 80 presents a smooth, blade-like configuration to logs that are driven against the splitter edge 108 when the apparatus 10 is operated. As is particularly shown in FIG. 5, the crossbar portion 102 is disposed on the body portion 98 asymmetrically with respect to the axis 110 of the socket 100 to divide the splitter head 80 into unequal length first and second splitter sections 112 and 114 disposed to either side of the axis 110, the second splitter section 114 being of greater length than the first splitter section 112. The splitter edge correspondingly has a first portion 116 that is formed on the first splitter section 112 of the splitter head 80 and a second portion 118 that is formed on the second splitter section section 114. For a purpose that will be discussed below, the sides 104 and 106 of the crossbar portion 102 of the splitter head 80 are formed such that the portions 116 and 118 of the splitter edge 108 are each canted toward the body portion 98 of the splitter head 80 so that the portions 116 and 118 of the splitter edge 108 meet at a point on the axis 110 of the socket 100. When the splitter head 80 is assembled with remaining portions of the apparatus 10, the canting of the portions 116 and 118 of the splitter edge 108 will result in such portions of the splitter edge 108 being canted toward the first end 38 of the log support 30 and away from the pusher 40 as has been shown in FIGS. 1 and 3.

The socket 100 is shaped to substantially mate with protruding portions of the splitter head mounting pin 90 so that the splitter head 80 can be pivotally mounted on the splitter head mount 78 by sliding the socket 100 in the splitter head 80 over the pin 90. To secure the splitter head 80 to the splitter head mount 78, flats 120 and 122 are formed in the periphery 124 of the body portion 198 of the splitter head 80 and a hole 126 is formed through the portion 98 to intersect the flats 120, 122 and the socket 100 in the portion 98 of the splitter head 80. The hole 126 is positioned on the splitter head 80 to align with the groove 92 about the splitter head mounting pin 90 when the pin 90 is seated against the bottom of the socket 100 so that the splitter head 80 can be secured to the splitter head 78 via a bolt 128 (FIG. 3) that extends through the hole 126 and the groove 90 and is held in place via a nut 130 on the threaded end thereof. The splitter head 80 can be strengthened by means of support bars 132 and 134 that extend from the periphery 124 of the body member 98 along the crossbar member 102 and are welded to each of the portions 98 and 102 of the splitter head 80.

The construction of the catcher assembly 36 is particularly shown in FIGS. 2 and 8 to which attention is now invited. As is particularly shown in FIG. 8, the catcher assembly comprises a first angle member 136 which extends along one side 138 of the log support 30 with the edge of one web of the angle member 136 abutting the side 138 of the log support 30 throughout the length of the angle member 136. A second angle member 140 is similarly positioned along the opposite side 142 of the log support 30. The remaining webs of the angle members 136 and 140; that is, the webs displaced laterally from the log support 30, extend downwardly from the webs of the angle members 136 and 140 that abut the sides of the log support 30. The catcher assembly 36 further comprises elongated clamps 144, 146 that underlay the webs of the angle members 136 and 140 that abut the log support 30 and the clamps 144, 146 have nose portions, 148 and 150 respectively, that extend under portions of the log support 30 adjacent the sides 138 and 142 thereof. The angle members 136, 140 and clamps 144, 146 are secured to remaining portions of the apparatus 10 via bolts 152 (see also FIG. 2) that pass through holes (not shown) in the base plate 44 of the pusher 40 and aligned holes in the angle members 136, 140 and clamps 144, 146 so that the angle members 136, 140 and clamps 144, 146 can be secured to the pusher 40 via the bolts 152 and nuts 154 thereon. Such mounting of the angle members and clamps is also utilized to secure the pusher 40 to the log support 30 in a manner that results in guiding of the pusher 40 along the log support 30 in the operation of the log splitting apparatus 10.

The catcher assembly 36 further comprises a first catcher platform 156 which is welded to the angle member 136 to extend laterally from the log support 30, on a level therewith, and a second catcher platform 158 that is welded to the angle member 140 to similarly extend laterally from the log support 30 on a level therewith. The platforms 156, 158 can be made light in weight by means of elongated slots, 160 and 162 respectively, formed therethrough. Gussets, two of which are shown in FIG. 8 and designated 164 therein, are welded between the undersides of the platforms 156 and 158 and the vertical webs of the angle members 136, 140 such that the angle members 136, 140 provide a rigid attachment between the platforms 156, 158 and the pusher 40.

The alignment of the platforms 156, 158 with billets formed by splitting a log are an important aspect of the present invention and the manner in which such alignment is effected has been indicated in FIG. 2 in which the positions the pusher 40 and platforms 156, 158 will occupy prior to operation of the apparatus 10 have been shown in phantom lines and the positions these components will occupy during operation have been shown in solid lines. The lengths of the angle members 136, 140 are selected, and the platforms 156, 158 are mounted on the angle members 136, 140, such that the platforms 156, 158 are aligned with central portions of the spacing between the pusher 40 and splitter assembly 34 and, accordingly, central portions of a log on the log support 30, when the pusher 40 is fully retracted as shown in phantom lines in FIG. 2. As the pusher 40 is moved along the drive path 42 to advance the log into the splitter assembly 34, a typical position of the pusher 40 during such advance being shown in solid lines in FIG. 2, the platforms 156, 158 advance to positions laterally disposed of the splitter assembly 34 so that the alignment between the platforms and central portions of the log is maintained throughout the advance of the log into the splitter assembly 34.

OPERATION OF THE PREFERRED EMBODIMENT

The above described construction of the log splitting apparatus 10 permits the apparatus 10 to be taken to work sites and, once at a site, to be quickly and easily set up for use. Since the assemblies of the apparatus 10 are mounted together on the trailer 12, the apparatus 10 can be prepared for use by extending the leg 28, so that the chassis 14 is supported on the leg 28 and the wheels of the trailer 12, and then starting the engine 58 to operate the hydraulic pump 56.

Following the start up of the engine 58, the operator of the apparatus 10 will place a log to be split on the log support 30 and then move the operating handle 76 to open the valve 74 through which pressurized hydraulic fluid is supplied from the pump 56 to the hydraulic actuating cylinder 54. The hydraulic fluid enters the end of a hydraulic actuating cylinder body 60 nearest the rear end 18 of the chassis 14, and is returned to the pump from the end of the body 60 that is remote from the rear end 18 of the chassis 14, to drive the piston rod 66 and pusher 40 connected thereto toward the splitter assembly 34. The pusher 40 engages one end of the log and forces the log along the drive path 42 so that the other end of the log engages the splitter edge 108 on the splitter head 80. In particular, the log will make initial contact with the pointed intersection of the two portions 116, 118 of the splitter edge 108 so that, as the splitter head 80 enters the log, the splitter head 80 will pivot on the splitter head mount 78 to find the path of least resistance of the log to splitting. As the movement of the log continues to force the splitter head more deeply into the log, any twisting of the grain of the log will give rise to a moment on the splitter head 80 and the splitter head 80 will pivot in response to such moment to automatically follow the grain of the log as the splitting operation is continued to completion. Concurrently with the movement of the log about the splitter head 80, the platforms 156, 158 advance alongside the log support 30 so that, when the billets into which the log is split break free from each other, the billets will roll onto the platforms 156, 158. The operator of the apparatus 10 then reverses the operating handle 76 to cause the hydraulic actuating cylinder 54 to draw the pusher 40 and platforms 156, 158 connected thereto back toward the rear end 18 of the chassis 14 in preparation for a subsequent splitting operation. Since the billets are drawn back to a position adjacent the position that the log occupied when loaded onto the apparatus 10, the billets will be close at hand to the operator of the apparatus 10 to facilitate unloading of billets. Moreover, since the billets will be supported by the platforms 156, 158 on a level with the log support 30, the operator of the apparatus 10 is afforded the additional convenience of not having to stoop to pick up the billets after they have been formed.

In some cases, the billets formed by an initial splitting operation will be larger than is desired for an intended use and, in such cases, the platforms 156, 158 facilitate splitting of the billets into smaller sizes. Since the platforms 156, 158 are drawn back to a position even with the position on the log support 30 that a log is placed for splitting as the pusher 40 is drawn away from the splitter assembly 34 for the next cycle of operation of the apparatus 10, all the machine operator need do to carry out the subsequent splitting of the billets is push them laterally from the platforms 156, 158 to the log support 30.

The pivotal mounting of the splitter head 30, in addition to enabling the splitter head 30 to take the path of least resistance through a log, further facilitates log splitting in another respect. In most cases, the splitter head 80 will be aligned with the log support 30 as has been shown in the drawings at the commencement of a log splitting operation; that is, with the longer second splitter section 114 of the splitter head 80 adjacent the log support 30 and the smaller first splitter section 112 thereof disposed above the pivotation axis 110. For smaller logs, such position will extend the splitter head 80 across the center of the log and across major portions of the log to either side of the center thereof. However, for larger logs, the extent of the splitter head 80 across upper portions of the end of the log may be insufficient to ensure splitting of the log; that is, while lower portions of the log are split, upper portions of the log will not be. In such cases, the splitter head 80 can be inverted to increase the vertical extent of the splitter head from the log support 30 and thereby cause the splitter head 80 to enter larger portions of the log to either side of the log center and thereby insure that the log will be split in a single operation of the apparatus 10.

It is clear that the present invention is well adapted to carry out the objects and obtain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. an apparatus for splitting a log into billets, comprising:

an elongated log support for receiving a log thereon;

log drive means for driving the log along a drive path toward one end of the log support; and a splitter assembly mounted on the log support at said one end thereof for splitting the log into billets as the log is driven into the splitter assembly by the log drive means, the splitter assembly comprising:

a splitter head mount secured to the log support to extend into said drive path; and a splitter head pivotally supported on the splitter head mount between the splitter head mount and the log drive means for pivotal movement on the splitter head mount about an axis extending along said drive path, the splitter head having a splitter edge formed on one side thereof facing away from said one end of the log support and the splitter head comprising:

a first splitter section extending laterally of the pivot axis of the splitter head on the splitter head mount and having a portion of the splitter edge formed thereon; and a second splitter section extending laterally of the pivot axis of the splitter head on the splitter head mount and having a portion of the splitter edge formed thereon, the second splitter section extending from said pivot axis in a direction opposite the extension of the first splitter section from said pivot axis; and said second splitter section has a greater lateral extent from said pivot axis than the lateral extent of the first splitter section from said pivot axis;

whereby when large diameter logs are to be split, the splitter head can be supported on said splitter mount so that said second section is above said first section, thereby increasing the vertical extent of the splitter head from said log support; and when small diameter logs are to be split said splitter head can be supported on said splitter mount so that said first section is above said second section.

2. The apparatus of claim 1 wherein the splitter head mount is characterized as comprising a splitter head mounting pin axially extending along the drive axis; wherein the splitter head is characterized as having a socket formed therein to receive said pin; and wherein the splitter head assembly further comprises means for securing said socket about said pin.

3. The apparatus of claim 2 wherein a circumferential groove is formed about portions of the splitter head mounting pin disposed within said socket; wherein a hole is formed through portions of the splitter head to intersect portions of the socket extending about the groove in the splitter head mounting pin; and wherein the means for securing the socket about the pin comprises a bolt extending through said hole to engage portions of the pin wherein said groove is formed.

4. The apparatus of claim 1 wherein portions of the splitter edge to either side of the splitter head pivotation axis are canted in a direction generally toward said one end of the log support.

5. The apparatus of claim 1 or 2 wherein portions of the splitter edge to either side of the splitter head pivotation axis are canted in a direction generally toward said one end of the log support.

6. The apparatus of claim 1 further comprising catcher means disposed alongside the log support for receiving the billets thereon.

7. The apparatus of claim 6 wherein the log drive means comprises:

a pusher slideably disposed on the log support for movement along the drive path; and means for alternatively moving the pusher toward and away from said one of the log support; and wherein the catcher means comprises:

a first catcher platform disposed along one side of the log support and attached to the pusher for movement therewith parallel to the drive path; and a second catcher platform disposed along the opposite side of the log support and attached to the pusher for movement therewith parallel to the drive path.

* * * * *